United States Patent [19]

Longenecker

[11] 4,182,060

[45] Jan. 8, 1980

[54] GREETING CARD

[76] Inventor: Lineaus W. Longenecker, R.D. #5, Manheim, Pa. 17545

[21] Appl. No.: 844,844

[22] Filed: Oct. 25, 1977

Related U.S. Application Data

[63] Continuation-in-part of Ser. No. 614,817, Sep. 18, 1975, Pat. No. 4,055,011.

[51] Int. Cl.[2] ..... G09F 1/000

[52] U.S. Cl. ..... 40/124.1

[58] Field of Search ..... 40/158, 124.1, 160; 46/34, 37

[56] References Cited

U.S. PATENT DOCUMENTS

| | | | |
|---|---|---|---|
| 2,155,193 | 4/1939 | Johntz | 46/35 |
| 2,201,479 | 5/1940 | Davidson | 46/35 X |
| 2,489,240 | 11/1949 | Meyer | 46/34 |
| 3,487,573 | 1/1970 | Slovacek | 46/37 |

FOREIGN PATENT DOCUMENTS

| | | | |
|---|---|---|---|
| 307994 | 9/1955 | Switzerland | 40/158 R |

*Primary Examiner*—Louis G. Mancene
*Assistant Examiner*—Wenceslao J. Contreras
*Attorney, Agent, or Firm*—Beveridge, DeGrandi, Kline & Lunsford

[57] ABSTRACT

A greeting card having a front leaf, a center leaf and a rear leaf is formed of a single piece of paper folded into quarters and cut at the upper edge of the center leaf, enabling the center leaf to move from a position where it overlies the rear leaf to a position where it overlies the front leaf. Pictorial material on the center leaf has the same shape and location as pictorial material on the underlying leaves; and, the center leaf has transparent cutouts which expose textual or pictorial material on the underlying leaves.

12 Claims, 4 Drawing Figures

GREETING CARD

REFERENCE TO RELATED APPLICATIONS

This is a continuation-in-part of my earlier application Ser. No. 614,817 filed Sept. 18, 1975, to issue Oct. 25, 1977 as U.S. Pat. No. 4,055,011.

BACKGROUND AND SUMMARY

This invention relates to a greeting card. The objects of the invention are to provide a greeting card which is attractive, interesting, uncomplicated and relatively inexpensive to manufacture.

Heretofore, some greeting cards have had die cut openings in their front flaps, so that a recipient would see a portion of the interior of the card before opening it.

Unlike these earlier cards, this invention is directed to a greeting card having a center leaf positioned between the front and rear leaves and constructed to provide, upon turning the center leaf, two different pictures of the same view, for example, the view in spring and the view in winter. The textual materials also change to develop a continuous expression such as a greeting message or a poem.

According to the invention, the card has a center leaf hingedly connected at the juncture of a front leaf and a rear leaf which together form a single view. The center leaf has transparent areas for exposing underlying pictorial or textual materials, and its pictorial elements which are exposed have a shape and location corresponding to the pictorial elements of the underlying leaf. A transparent area of the center leaf is aligned with textual material on one of the underlying leaves so that this textual material is visible when the center leaf is in either of its positions.

A single preferred embodiment of the invention is disclosed herein solely for illustrative purposes, and not for limitative purposes.

THE DRAWINGS

DESCRIPTION OF THE PREFERRED EMBODIMENT

Figure 1:
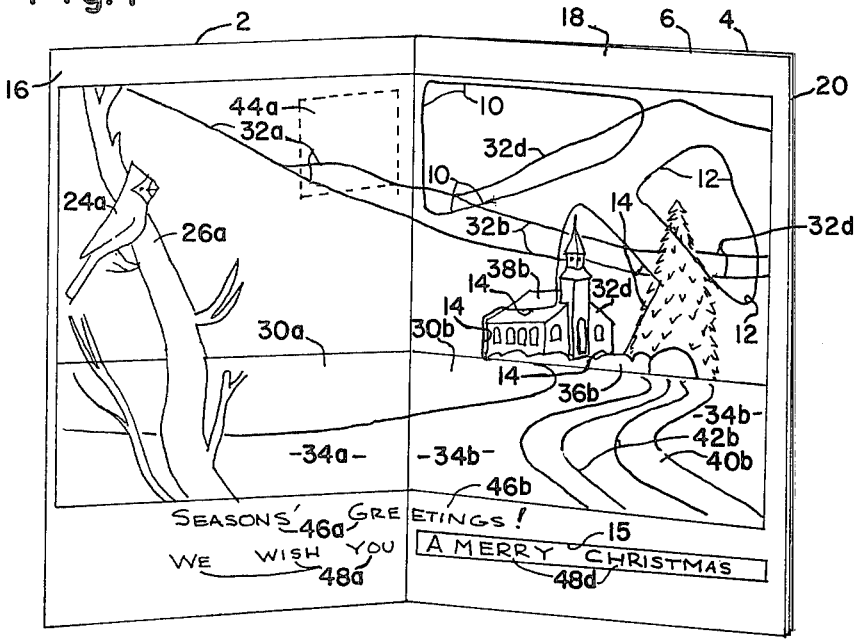
FIG. 1 shows the greeting card when opened by the recipient, with the center leaf overlying the rear leaf.
Figure 2:
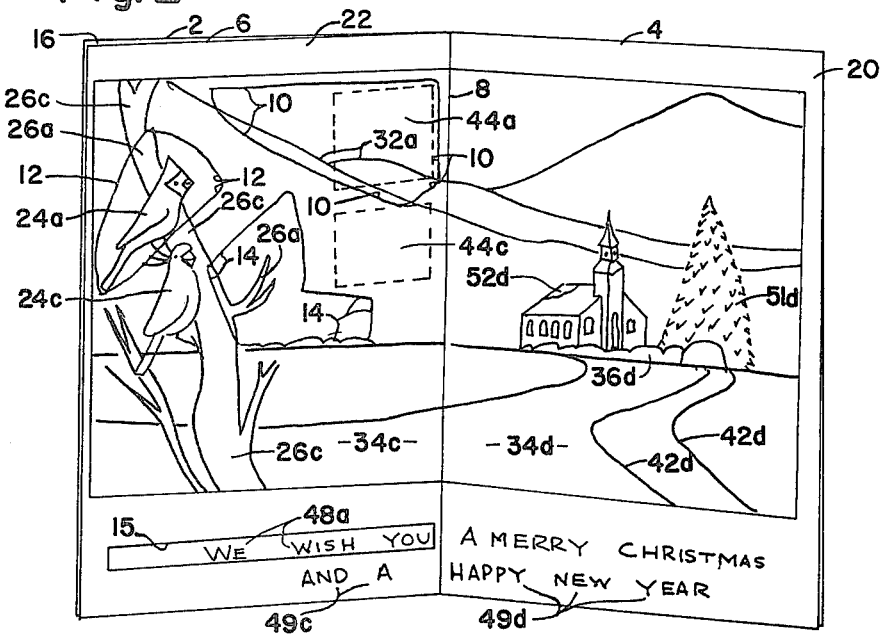
FIG. 2 shows the greeting card after the center leaf has been turned to overlie the front leaf.

The greeting card includes a front leaf 2, a rear leaf 4 and a center leaf 6 which is located between the front and rear leaves and is hinged on fold line 8 for movement from the first position shown in FIG. 1 to the second position shown in FIG. 2. The center leaf is die cut at 10, 12, 14 and 15 to provide transparent openings which expose pictorial or textual materials therebeneath.

The reference numerals in this specification include the letter a to denote materials printed on the rear side of the front leaf, b to denote materials printed on the front side of the center leaf, c to denote materials printed on the rear side of the center leaf and d to denote materials printed on the front side of the rear leaf.

When the card is opened, it is presented as shown in FIG. 1 so the observer sees all materials on the rear side 16 of the front leaf 2, all materials on the front side 18 of the center leaf 6, and portions of the materials on the front side 20 of the rear leaf 4. The rear side 22 of the center leaf is not visible.

The pictorial materials on sides 16 and 18 together form a single springtime landscape view. A single winter view of the same landscape is depicted by the sides 22 and 20. The sides 16 and 20 show a single view of the same landscape, the half thereof on side 16 being a springtime view and the half on 20 being a snow covered winter view.

The pictorial portions seen in FIG. 1 include a single bird **24*a* on a tree 26*a*. The lake portions 30*a* and 30*b* appear in the foreground and the mountain profiles 32*a*, 32*b* and 32*d* are in the background. The colors are representative of springtime, the grass areas 34*a* and 34*b* being green and the flowering shrubs 36*b* being brightly colored at their height of bloom. No snow patches are visible on the ground or on the roof portion 38*b* of the church 38*d* which is seen through the cutaway 14. The road 40*b* has tire ruts 42*b***.

The textual materials visible when the card is in the FIG. 1 position include a first poetic stanza in the area **44*a*, a salutation having a first line with portions 46*a* and 46*b*, and a second line having portions 48*a* and 48*d*, the latter being visible through the transparent cutaway area 15 in the center leaf 6**.

When the center leaf 6 is turned from right to left, it will overlie the rear side 16 of front leaf 2, its opaque portions covering parts of the materials on side 16 and presenting the winter scene shown in FIG. 2.

Parts of the pictorial and textual portions printed on the rear side 16 of the front leaf will remain visible through the cutaway transparent areas. Cutaway 10 exposes an area which includes the mountain profiles **32*a* and the area 44*a* of the first poetic stanza. The cutaway 12 leaves the bird 24*a* and the tree portions 26*a* visible, and cutaway 14 exposes a tree portion 26*a*. The cutaway 15, being aligned with the message portion 48*a*, permits continued viewing of the complete second line of the salutation. The rear side 22 of leaf 6 has tree portions 26*c* and a second bird 24*c* which presents a pictorial element which is additional to the pictorial elements on the rear side 16 of the front leaf. The areas 34*c* and 34*d* are snow covered and tire ruts 42*d* appear in the snow. Snow patches are located on the shrubs 36*d*, the lower portions of the tree 51*d* and on the church roof at 52*d*. In the area 44*c*, the rear side 22 of the leaf has a stanza of the poem commenced in area 44*a*, continuing the poetic expression. Also the message portions 49*c* and 49*d* become visible in the FIG. 2** position.

To simplify manufacture, the greeting card is formed of a single piece of paper, cut and folded to provide the leaves shown in FIGS. 1 and 2. The layout of such a card is illustrated in FIGS. 3 and 4, each showing one side of the printed paper prior to folding it into the configuration of FIGS. 1 and 2.

Figure 3:
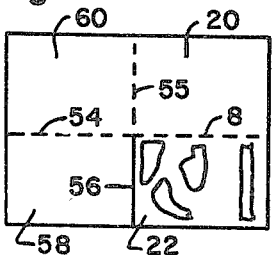
FIGS. 3 and 4 show opposite sides of the card in flat condition prior to being folded into the configuration of FIGS. 1 and 2.

In FIG. 3, it will be seen that the paper is provided with fold lines 8, 54 and 55 and a die cut line forming edges 56. The front side of the front leaf of the card, not seen in FIGS. 1 and 2, is designated 58. The rear side of the central leaf is shown at 22 and the front side of the rear leaf is shown at 20. 60 is the rearmost panel of the card, only the edge of which is seen in FIGS. 1 and 2.

Figure 4:
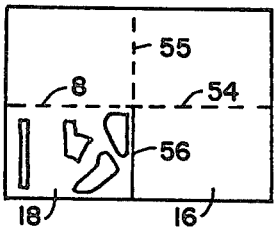

FIG. 4 also shows the fold lines 8, 54 and 55 and the die cut line 56 which separates the rear side of the front leaf and the front side of the center leaf. It will be evident that the printed blank as shown in FIGS. 3 and 4, when folded, will result in the greeting card as illustrated in FIGS. 1 and 2.

The card is manufactured by printing and die cutting both sides of the blank as shown in FIGS. 3 and 4, folding the blank along line 55 and then simultaneously folding it along the lines 8 and 54 so the center leaf 6 lies between the front leaf 2 and rear leaf 4. The front leaf 2 and center leaf 6 will each possess a single thickness, while rear leaf 4 will have a double thickness joined to itself along the fold line 55.

While only a preferred embodiment of the invention has been shown, those familiar with the art will realize that a wide variety of greeting cards may be made according to the principles of the invention. Therefore, it is emphasized that the invention is not limited only to the single disclosed embodiment, but is embracing of other modifications and variations thereto falling within the spirit of the following claims.

I claim:

1. A greeting card comprising a front leaf having a rear side, a rear leaf having a front side adjoining the rear side of the front leaf, pictorial materials on said rear side of the front leaf and on the front side of the rear leaf which together form a single view, a center leaf positioned between the front leaf and the rear leaf and hingedly supported at the juncture of said rear side of the front leaf and the front side of the rear leaf, said center leaf being movable from a first position where it overlies the front side of the rear leaf to a second position where it overlies the rear side of the front leaf, said center leaf having a front side provided with pictorial elements which have a shape and location corresponding to the shape and location of pictorial elements on the front side of the rear leaf, said center leaf having a rear side provided with pictorial elements which have a shape and location corresponding to the shape and location of pictorial elements on the rear side of the front leaf, said center leaf having transparent areas for exposing portions of said sides lying therebeneath and opaque areas for concealing portions of said sides lying therebeneath, textual material on one of said rear side of the front leaf or front side of said rear leaf, said transparent area being aligned with said textual material whereby said textual material aligned with said transparent area is visible when the center leaf is in either of said positions.

2. The greeting card of claim 1 having on one of said sides textual material which is not aligned with said transparent portion so as to be visible when said center leaf is in one of its positions and to be concealed when said center leaf is in the other one of its said positions.

3. The greeting card of claim 2 wherein the textual material includes a continuous expression a portion of which is the textual material aligned with the transparent portion and a portion of which is not aligned with the transparent portion.

4. The greeting card of claim 3 wherein the continuous expression is a poem and said portions are stanzas thereof.

5. The greeting card of claim 1 wherein one side of the center leaf has an additional pictorial element than exists on the underlying side of the adjacent leaf.

6. The greeting card of claim 5 having on one of said sides textual material which is not aligned with said transparent portion so as to be visible when said center leaf is in one of its positions and to be concealed when said center leaf is in the other one of its said positions.

7. The greeting card of claim 6 wherein the textual material includes a continuous expression a portion of which is the textual material aligned with the transparent portion and a portion of which is not aligned with the transparent portion.

8. The greeting card of claim 1 wherein said leaves are formed of a single piece of paper cut at the upper edge of said center leaf and folded into quarters to enable the center leaf to move from its first position to its second position.

9. The greeting card of claim 8 having on one of said sides textual material which is not aligned with said transparent portion so as to be visible when said center leaf is in one of its positions and to be concealed when said center leaf is in the other one of its said positions.

10. The greeting card of claim 9 wherein one side of the center leaf has an additional pictorial element than exists on the underlying side of the adjacent leaf.

11. The greeting card of claim 9 wherein the textual material includes a continuous expression a portion of which is the textual material aligned with the transparent portion and a portion of which is not aligned with the transparent portion.

12. The greeting card of claim 11 wherein the continuous expression is a poem and said portions are stanzas thereof.

* * * * *